US010079136B2

(12) United States Patent
Brown et al.

(10) Patent No.: US 10,079,136 B2
(45) Date of Patent: Sep. 18, 2018

(54) SELF-CALIBRATION OF SPECTRA USING DIFFERENCES IN MOLECULAR WEIGHT FROM KNOWN CHARGE STATES

(71) Applicant: Micromass UK Limited, Wilmslow (GB)

(72) Inventors: Jeffery Mark Brown, Hyde (GB); Paul Murray, Manchester (GB); Keith Richardson, High Peak (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/317,314

(22) PCT Filed: Jun. 12, 2015

(86) PCT No.: PCT/GB2015/000182
§ 371 (c)(1),
(2) Date: Dec. 8, 2016

(87) PCT Pub. No.: WO2015/189550
PCT Pub. Date: Dec. 17, 2015

(65) Prior Publication Data

US 2017/0125222 A1 May 4, 2017

(30) Foreign Application Priority Data

Jun. 12, 2014 (GB) ..... 1410470.7

(51) Int. Cl.
*H01J 49/40* (2006.01)
*H01J 49/10* (2006.01)
*H01J 49/00* (2006.01)

(52) U.S. Cl.
CPC ..... *H01J 49/0009* (2013.01); *H01J 49/0031* (2013.01); *H01J 49/0036* (2013.01); *H01J 49/40* (2013.01)

(58) Field of Classification Search
CPC ..... H01J 49/0009; H01J 49/0031; H01J 49/0036; H01J 49/0027; H01J 49/40;
(Continued)

(56) References Cited

U.S. PATENT DOCUMENTS 5,635,713 A * 6/1997 Labowsky ..... H01J 49/0027 250/282
5,750,988 A * 5/1998 Apffel ..... G01N 30/7253 250/288

(Continued)

FOREIGN PATENT DOCUMENTS

WO 2009023946 2/2009

*Primary Examiner* — David A Vanore

(57) ABSTRACT

A method of calibrating a mass spectrometer is disclosed comprising mass analyzing first ions derived from an analyte molecule, wherein the first ions have a first charge state; determining a first mass or mass to charge ratio of the first ions; mass analyzing second ions derived from the analyte molecule, wherein the second ions have a second different charge state and wherein the second ions comprise protonated or adduct variants of the first ions; determining a second mass or mass to charge ratio of the second ions; a determining a calibration correction based upon the first mass or mass to charge ratio and the second mass or mass to charge ratio.

23 Claims, 1 Drawing Sheet

(58) Field of Classification Search

CPC .... H01J 49/004; H01J 49/0045; H01J 49/025; H01J 49/165; H01J 49/10; H01J 49/26; H01J 49/34; H01J 49/38; H01J 49/401; H01J 49/405; H01J 49/4215; H01J 49/0072; H01J 49/02; H01J 49/022; H01J 49/04; H01J 49/0431; H01J 49/0495; H01J 49/105; H01J 49/107; H01J 49/12; H01J 49/145; H01J 49/168; H01J 49/425; G01N 2030/8417; G01N 27/622; G01N 30/7233; G01N 30/7253; G01N 23/04; G01N 24/00; G01N 33/6803

USPC ..... 250/281, 282, 287, 288, 285, 252.1, 292

See application file for complete search history.

(56) References Cited

U.S. PATENT DOCUMENTS

| | | | | |
|---|---|---|---|---|
| 6,031,228 | A * | 2/2000 | Abramson | H01J 49/0027 250/281 |
| 6,188,064 | B1 * | 2/2001 | Koster | H01J 49/0036 250/281 |
| 6,294,779 | B1 * | 9/2001 | Apffel | G01N 30/7253 250/288 |
| 6,498,340 | B2 | 12/2002 | Anderson et al. | |
| 6,580,071 | B2 * | 6/2003 | Weinberger | H01J 49/0009 250/282 |
| 6,608,302 | B2 * | 8/2003 | Smith | H01J 49/0009 250/252.1 |
| 6,717,134 | B2 * | 4/2004 | Bowdler | H01J 49/0009 250/282 |
| 7,071,463 | B2 * | 7/2006 | Bowdler | H01J 49/0009 250/281 |
| 7,138,624 | B2 | 11/2006 | Kato | |
| 7,979,258 | B2 * | 7/2011 | Goldberg | H01J 49/0036 702/19 |
| 8,399,827 | B1 * | 3/2013 | Grothe | H01J 49/0036 250/282 |
| 8,507,849 | B2 * | 8/2013 | Brown | H01J 49/0031 250/281 |
| 9,159,538 | B1 * | 10/2015 | McClure | H01J 49/0036 |
| 9,324,543 | B2 * | 4/2016 | Kenny | H01J 49/0031 |
| 9,324,545 | B2 * | 4/2016 | Green | H01J 49/0009 |
| 9,418,824 | B2 * | 8/2016 | Wildgoose | H01J 49/0009 |
| 9,594,879 | B2 * | 3/2017 | Eiler | G06F 19/703 |
| 9,697,995 | B2 * | 7/2017 | Bateman | H01J 49/0031 |
| 9,805,920 | B2 * | 10/2017 | Kenny | H01J 49/0009 |
| 2004/0108452 | A1 * | 6/2004 | Graber | G01N 33/6803 250/281 |
| 2006/0138320 | A1 * | 6/2006 | Bateman | H01J 49/0031 250/288 |
| 2006/0175266 | A1 * | 8/2006 | Rima | C02F 1/725 210/764 |
| 2006/0195271 | A1 * | 8/2006 | Park | H01J 49/0036 702/27 |
| 2011/0189788 | A1 * | 8/2011 | Brown | H01J 49/0072 436/173 |
| 2014/0097338 | A1 * | 4/2014 | Eiler | H01J 49/0009 250/282 |
| 2014/0246575 | A1 * | 9/2014 | Langridge | H01J 49/025 250/282 |
| 2015/0041635 | A1 | 2/2015 | Green et al. | |
| 2016/0027628 | A1 * | 1/2016 | Green | H01J 49/025 250/282 |
| 2016/0126074 | A1 * | 5/2016 | Green | G01N 27/622 250/282 |
| 2017/0047208 | A1 | 2/2017 | Brown | |
| 2017/0131238 | A1 * | 5/2017 | Giles | G01N 27/622 |

* cited by examiner

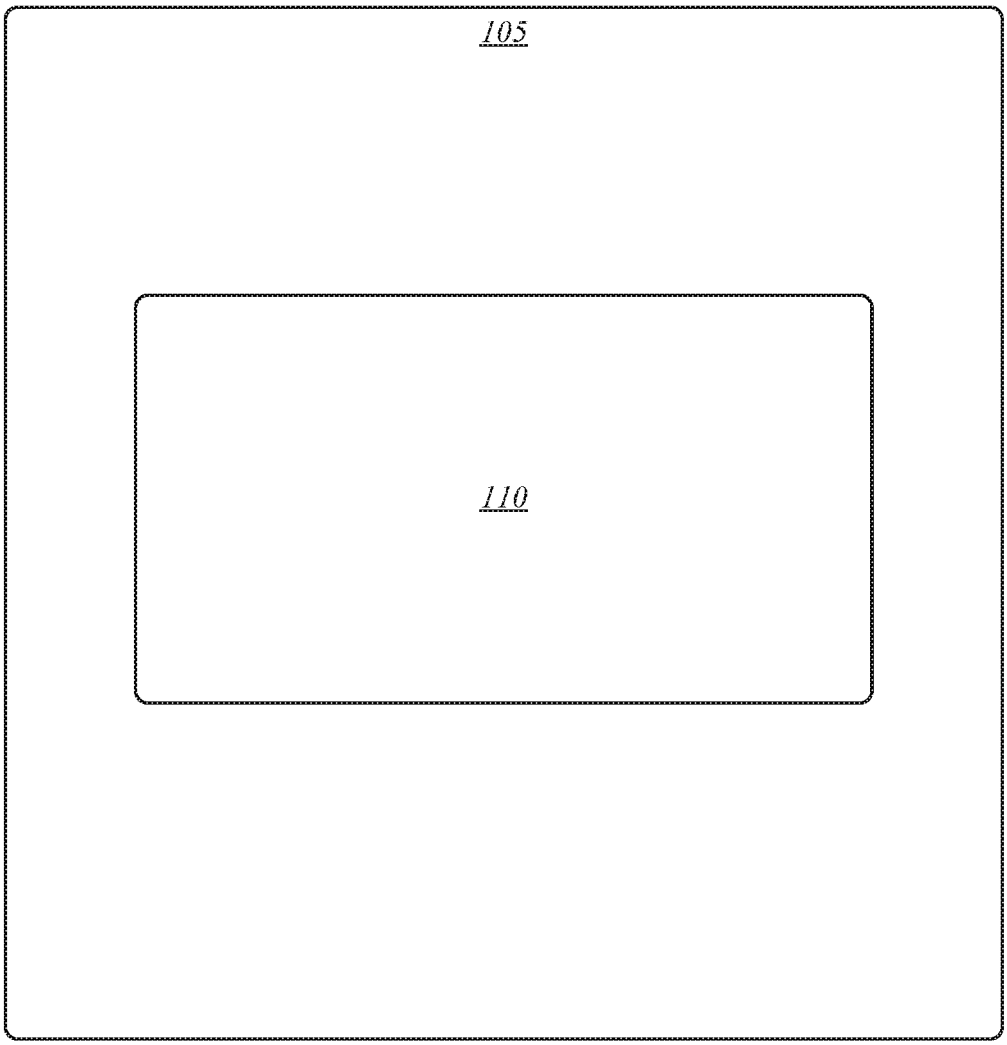
105
110

SELF-CALIBRATION OF SPECTRA USING DIFFERENCES IN MOLECULAR WEIGHT FROM KNOWN CHARGE STATES

CROSS-REFERENCE TO RELATED APPLICATIONS

This application represents the U.S. National Phase of International Application number PCT/GB2015/000182 entitled "Self-Calibration of Spectra Using Differences in Molecular Weight from Known Charge States" filed 12 Jun. 2015, which claims priority from and the benefit of United Kingdom patent application No. 1410470.7 filed on 12 Jun. 2014. The entire contents of these applications are incorporated herein by reference.

FIELD OF THE PRESENT INVENTION

The present invention relates to a method of calibrating a mass spectrometer, a method of mass spectrometry and a mass spectrometer. The embodiments relate to methods of calibrating a Time of Flight mass spectrometer.

BACKGROUND

It is known to calibrate the mass to charge ratio scale of a mass spectrometer by fitting data from known ion peaks (reference standard) to the underlying scan law employed by the mass spectrometer (e.g. time of flight function). This calibration may be performed before, after and/or during the acquisition of an unknown analyte.

Internal calibration refers generally to a calibration method wherein a known reference standard is added to the analyte sample itself and the mixture of analyte sample and reference standard is then ionised and mass analysed. This method can be problematic since the reference standard needs to be carefully selected such that when the reference standard is ionised then reference standard ions are generated at a similar intensity to those of the unknown analyte in order to minimise or avoid saturation effects. Furthermore, the reference standard ions must have mass to charge ratios which are different to the analyte ions in order to avoid interference effects.

Another more common form of calibration is known and is referred to as external calibration or lock massing. External calibration or lock massing refers to a method wherein the calibration is corrected at predetermined calibration time points. This approach relies on the stability of the system between calibration time points. However, this can be problematic if short term perturbations occur to the components of the mass spectrometer (e.g. voltage drift). Furthermore, external calibration or lock massing also suffers from the problem that it increases the cost of the overall mass spectrometer as the approach requires the provision of a separate dedicated ionisation source to generate the reference standard or lockmass ions. Furthermore, the system needs to temporarily switch between the analyte and the reference standard thereby causing a loss of analyte data. A yet further problem with known external calibration methods is that the mass spectrometer will switch to perform a calibration check during an acquisition at predetermined times and this can sometimes accidentally coincide with a time when analyte of interest elute from e.g. a liquid chromatography separation device with the result that at least some potential analyte ions of interest are not generated or detected.

US 2002/130259 (Anderson) discloses a method of calibration in Fourier Transform Ion Cyclotron Resonance mass spectrometry. An embodiment comprises identifying a plurality of ions having known mass differences and having differing charge states, and adjusting the calibration parameters to cause the plurality of ions to be shifted to a relative position that corresponds to the known mass differences. Then measured mass to charge signal of analyte ions are adjusted using the adjusted calibration parameter.

EP 1672673 (Palo Alto) discloses a calibration method in which transformation parameters, A and B, determined using plural peaks of observed mass, are used to transform a measured mass spectrum according to Ax+B, where x is the measured mass. The intercept B can be estimated using mass measurements of a singly charged ion and a doubly charged ion.

It is therefore desired to provide an improved method of calibrating a mass spectrometer.

SUMMARY

According to an aspect there is provided a method of calibrating a mass spectrometer comprising:

mass analysing first ions derived from an analyte molecule, wherein the first ions have a first charge state;

determining a first mass or mass to charge ratio of the first ions;

mass analysing second ions derived from the analyte molecule, wherein the second ions have a second different charge state and wherein the second ions comprise protonated or adduct variants of the first ions;

determining a second mass or mass to charge ratio of the second ions; and determining a calibration correction based upon the first mass or mass to charge ratio and the second mass or mass to charge ratio.

The accuracy of the calibration correction may be determined by the difference in charge between the first charge state and the second charge state.

The accuracy of the calibration correction may be improved by increasing the difference in charge between the first charge state and the second charge state.

According to another aspect, there is provided a method of calibrating a mass spectrometer comprising:

mass analysing first ions derived from an analyte molecule and first adduct ions;

determining a first mass or mass to charge ratio of the first ions;

mass analysing second ions derived from the analyte molecule and second adduct ions, wherein the second adduct ions have a second different mass to the first adduct ions;

determining a second mass or mass to charge ratio of the second ions; and determining a calibration correction based upon the first mass or mass to charge ratio and the second mass or mass to charge ratio.

Typically, for time of flight mass analyzers, when the calibration "drifts", this is usually caused by thermal changes which may change the power supply outputs or may cause thermal expansion of the flight tube. The calibration drift causes an unknown change in the gain or linear drift in the mass axis. If the masses measured after the drift were multiplied by the inverse of the gain error, they can be accurately corrected. In general, a predominant error in time of flight calibrations is caused by a change in gain. Higher order terms as well as the time of flight offset (intercept) are generally not significantly affected by thermal drifts.

According to the embodiments, a calibration correction may be determined by measuring two species of analyte ions with two different charge state or two species of analyte ions derived from adduct ions of two different masses. It is therefore possible to account for calibration drifts, thereby improving the accuracy of mass measurements. Further embodiments are contemplated in which the two (or more) species of analyte ions may be derived from adduct ions of different masses as well as having different charge states.

The accuracy of the calibration correction may be determined by the difference in mass between the first adduct ions and the second adduct ions.

The accuracy of the calibration correction may be improved by increasing the difference in mass between the first adduct ions and the second adduct ions.

The step of determining the calibration correction may comprise determining a linear drift $\alpha$ of a mass, mass to charge ratio or time of flight scale of the mass spectrometer.

The linear drift $\alpha$ may be determined from the relationship $$\alpha = \frac{aM'_a - bM'_b}{(a-b)H}$$

wherein a is the charge state of the first ions, $M_a'$ is the mass to charge ratio of the first ions, b is the charge state of the second ions, $M_b'$ is the mass to charge ratio of the second ions and H is the mass of a proton.

The linear drift $\alpha$ may be determined from the relationship $$\alpha = \frac{aM'_a - bM'_b}{\Delta_a - \Delta_b}$$

wherein a is the charge state of the first ions, $M'_a$ is the mass to charge ratio of the first ions, $\Delta_a$ is the mass of adduct ions from which the first ions derived, b is the charge state of the second ions, $M'_b$ is the mass to charge ratio of the second ions and $\Delta_b$ is the mass of adduct ions from which the second ions derived.

The method may further comprise using the calibration correction to correct the mass, mass to charge ratio or time of flight scale or calibration of the mass spectrometer.

The method may further comprise determining an uncertainty value for the calibration correction.

The step of determining the uncertainty value may comprise determining a standard deviation $\Sigma$ of the calibration correction, and the standard deviation $\Sigma$ is determined from the relationship $$\Sigma^2 = \frac{\Sigma_a^2 + \Sigma_b^2}{(\Delta_a - \Delta_b)^2},$$

where $\Sigma_a$ is the standard deviation associated with the measurement of the first ions, $\Delta_a$ is the mass of adduct ions from which the first ions derived, $\Sigma_b$ is the standard deviation associated with the measurement of the second ions, and $\Delta_b$ is the mass of adduct ions from which the second ions derived.

The method may further comprise:

mass analysing third ions derived from the analyte molecule, wherein the third ions have a third different charge state and wherein the third ions comprise protonated or adduct variants of the first and second ions;

determining a third mass or mass to charge ratio of the third ions; and determining a calibration correction based upon the first mass or mass to charge ratio, the second mass or mass to charge ratio and the third mass or mass to charge ratio.

The method may further comprise determining an uncertainty value for said calibration correction by determining a standard deviation $\Sigma$ of said calibration correction, and said standard deviation $\Sigma$ is determined from the relationship $$\Sigma^2 = \frac{\frac{1}{\Sigma_a^2} + \frac{1}{\Sigma_b^2} + \frac{1}{\Sigma_c^2}}{\frac{(\Delta_b - \Delta_c)^2}{\Sigma_b^2\Sigma_c^2} + \frac{(\Delta_a - \Delta_c)^2}{\Sigma_a^2\Sigma_c^2} + \frac{(\Delta_a - \Delta_b)^2}{\Sigma_a^2\Sigma_b^2}}$$

where $\Delta_a$ is the mass of adduct ions from which said first ions derived, $\Sigma_a$ is the standard deviation associated with the measurement of the first ions, $\Sigma_b$ is the mass of adduct ions from which said second ions derived, $\Sigma_b$ is the standard deviation associated with the measurement of the second ions, $\Delta_c$ is the mass of adduct ions from which said third ions derived, $\Sigma_c$ is the standard deviation associated with the measurement of the third ions.

The method may further comprise determining if the calibration correction is to be applied to correct the mass, mass to charge ratio or time of flight scale or calibration of the mass spectrometer based on the determined uncertainty value.

The calibration correction may be applied when the determined uncertainty value is below a threshold value.

The calibration correction may be determined for each of a plurality of different analyte molecules, and the determined calibration corrections are combined to obtain a combined calibration correction.

The mass spectrometer may comprise a Time of Flight mass spectrometer.

According to another aspect there is provided a method of mass spectrometry comprising:

a method of calibrating a mass spectrometer as discussed above.

The method may further comprise calibrating the mass spectrometer without adding a reference standard to an analyte sample to be analysed.

The method may further comprise calibrating the mass spectrometer without using an ion source to generate a plurality of lockmass or external calibration ions.

The method may further comprise performing an instrument recalibration when the calibration correction exceeds a predetermined threshold value.

According to another aspect there is provided a mass spectrometer comprising a control system arranged and adapted:

(i) to mass analyse first ions derived from an analyte molecule, wherein the first ions have a first charge state;

(ii) to determine a first mass or mass to charge ratio of the first ions;

(iii) to mass analyse second ions derived from the analyte molecule, wherein the second ions have a second different charge state and wherein the second ions comprise protonated or adduct variants of the first ions;

(iv) to determine a second mass or mass to charge ratio of the second ions; and (v) to determine a calibration correction based upon the first mass or mass to charge ratio and the second mass or mass to charge ratio.

According to another aspect, there is provided a mass spectrometer comprising a control system arranged and adapted:

(i) to mass analyse first ions derived from an analyte molecule and first adduct ions;

(ii) to determine a first mass or mass to charge ratio of the first ions;

(iii) to mass analyse second ions derived from the analyte molecule and second adduct ions, wherein the second adduct ions have a second different mass to the first adduct ions;

(iv) to determine a second mass or mass to charge ratio of the second ions; and (v) to determine a calibration correction based upon the first mass or mass to charge ratio and the second mass or mass to charge ratio.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage may have an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage may have a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWING

FIG. 1 depicts an illustrative mass spectrometry system according to some embodiments.

DETAILED DESCRIPTION

An embodiment will now be described.

The molecular weight of an analyte molecule calculated from two different charge state analyte ion peaks wherein the analyte ions are charged through the addition of known adduct species (e.g. a proton or a sodium or potassium atom) should be the same for a perfectly calibrated mass to charge ratio scale.

However, in practice, the determined molecular weights will differ slightly since the mass to charge ratio scale is likely to have drifted and hence will not be perfectly calibrated.

If the mass to charge ratio scale has drifted by an instrumental drift factor then according to the embodiment it is possible to calculate the instrumental drift (and thus to correct for it) based on the difference in the calculated molecular weight of an analyte based upon corresponding analyte ions having different charge states.

For a mass spectrum containing a singly charged ion and a corresponding doubly charged ion of the same unknown analyte species, the mass to charge ratio $M_1$ of the singly charged (protonated) analyte ion may be expressed as:

$$M_1=\mathrm{mw}+H \tag{1}$$

where mw is the molecular weight of the analyte molecule and H is the mass of a proton.

Similarly, the mass to charge ratio $M_2$ of the doubly charged species can be expressed as:

$$M_2=(\mathrm{mw}+2H)/2 \tag{2}$$

This gives the relationship:

$$2M_2=M_1+H \tag{3}$$

$$H=2M_2-M_1 \tag{4}$$

A linear drift α in the calibration would result in measured mass to charge values:

$$M_1'=\alpha M_1 \tag{5}$$

$$M_2'=\alpha M_2 \tag{6}$$

Accordingly:

$$H'=\alpha H \tag{7}$$

$$\alpha=H'/H \tag{8}$$

$$H'=2M_2'-M_1' \tag{9}$$

Therefore, the linear drift α in the calibration in terms of singly charged and doubly charged ions can be expressed as:

$$\alpha=\frac{2M_2'-M_1'}{H} \tag{10}$$

The above expression relating the linear drift α expressed in terms of singly and doubly charged ions can be generalised to cover any two charge states (a and b) giving rise to the expression:

$$\alpha=\frac{aM_a'-bM_b'}{(a-b)H} \tag{11}$$

If the charge state difference is due to the inclusion of adducts such as sodium or potassium (instead of H) then the larger mass of the adduct will improve the precision of the correction factor.

In the embodiment described above, the same adduct is used to achieve the two different charge states of analyte ions. However, embodiments have been contemplated in which one type of adduct ions is used to obtain a first charge state and a second different type of adduct ions is used to obtain a second charge state.

In an embodiment, the standard deviation in the determined linear drift α can be calculated using a probabilistic approach as shown below.

The two observed species are related by the unknown common mass mw, differing by known adduct masses $\Delta_1$ and $\Delta_2$ measured at known charge states a and b, $$\mathrm{mw}+\Delta_1 \tag{12}$$

$$\mathrm{mw}+\Delta_2 \tag{13}$$

measured at known charge states a and b. Note that the adduct masses $\Delta_1$ and $\Delta_2$ include any change in mass related to ionization (e.g. addition of protons, or loss of electrons). In these expressions the subscripts 1 and 2 refer to the adduct index and not to charge state. Indeed the two charge states may be equal in which case a=b.

The two species give two measured m/z values $M'_1$ and $M'_2$, with corresponding uncertainties $\sigma_1$ and $\sigma_2$, $$M'_1\pm\sigma_1 \tag{14}$$

$$M'_2\pm\sigma_2 \tag{15}$$

The measured mass axis is perturbed by an unknown gain or linear drift α, such that (c.f. equations (5) and (6))

$$M_1'\sim\alpha\frac{mw+\Delta_1}{a} \tag{16}$$

$$M_2'\sim\alpha\frac{mw+\Delta_2}{b} \tag{17}$$

Given that the measurements of $M'_1$ and $M'_2$ are imperfect and carry uncertainties, the linear drift α determined using these measurements would also carry uncertainties that can be characterized by its standard deviation.

Assuming that the likelihood of measuring $M'_1$ takes the form of a Gaussian distribution, then the probability of observing the value $M'_1$ is $$P(M_1'\mid mw,\alpha)=\frac{1}{\sqrt{2\pi}\,\sigma_1}\exp\left(-\frac{\left(M_1'-\alpha\frac{mw+\Delta_1}{a}\right)^2}{2\sigma_1^2}\right) \tag{18}$$

Similarly for $M_2'$:

$$P(M_2'\mid mw,\alpha)=\frac{1}{\sqrt{2\pi}\,\sigma_2}\exp\left(-\frac{\left(M_2'-\alpha\frac{mw+\Delta_2}{b}\right)^2}{2\sigma_2^2}\right) \tag{19}$$

Other choices of distribution may be used instead, but given reasonable mass spectrometric peak shapes, the Gaussian form is usually adequate.

Since the value of mw is unknown, and not of primary interest, it can be treated as a "nuisance variable" and mathematically remove from equations (18) and (19) (this is known as "marginalization" of the mw variable).

Using Bayes theorem, and assuming (for simplicity) uniform priors on mw and α, an expression for the probability distribution (inference) for α is obtained:

$$P(\alpha\mid M_1',M_2')=\frac{K}{\alpha}\exp\left(-\frac{(\alpha-\alpha_0)^2}{2\Sigma^2}\right) \tag{20}$$

where K is a normalization constant, $$\alpha_0=\frac{aM_1'-bM_2'}{\Delta_1-\Delta_2} \tag{21}$$

In summary, the linear drift or correction factor α to be used for calibration is the difference of the measured masses at the different charge states (i.e. the product of the mass to charge ratio and the charge) divided by the difference of the adduct masses used to obtain the different charge states. Note that in the case $\Delta_1$=aH and $\Delta_2$=bH, $M_1'=M_a'$ and $M_2'=M_b'$, this expression is identical to equation (11).

$$\Sigma^2 = \frac{\Sigma_2^1 + \Sigma_2^2}{(\Delta_1 - \Delta_2)^2} \tag{22}$$

$$\Sigma_1 = a\sigma_1 \tag{23}$$

$$\Sigma_2 = b\sigma_2 \tag{24}$$

For data of sufficient quality, the probability distribution of $\alpha$ is approximately a Gaussian probability distribution centered on $\alpha_0$ with a standard deviation of $\Sigma$. For example, if $M'_1$ and $M'_2$ are singly charged and measured to 1 ppm ($mw \times 10^{-6}$ Da) then the uncertainty in the linear shift $\alpha$ is $$\Sigma = \frac{\sqrt{2}\, mw}{|\Delta_1 - \Delta_2|} ppm \tag{25}$$

The achievable accuracy, which is inversely proportional to the standard deviation $\Sigma$, is therefore directly related to the difference in adduct mass divided by the molecular weight $|\Delta_1-\Delta_2|/mw$. In other words, accuracy can be improved by increasing the mass difference between the two types of adduct ions used to achieve the two different charge states.

It is therefore desirable to minimize the factor $mw/(\Delta_1-\Delta_2)$ and this can be done, for example, by employing larger charge carrying adducts and/or by generating larger charge differences using for example charge stripping or supercharging methods. (It should be noted that, although the charge difference does not appear explicitly in this factor, it is normally the case that for increasing charge, the adduct difference also increases.)

The same logic can be applied to the situation in which three or more known adducts are present. In the case of three adducts, $$\alpha_0 = \frac{aM_1'\left(\frac{\Delta_1-\Delta_3}{\Sigma_1^2\Sigma_3^2} + \frac{\Delta_1-\Delta_2}{\Sigma_1^2\Sigma_2^2}\right) + bM_2'\left(\frac{\Delta_2-\Delta_3}{\Sigma_2^2\Sigma_3^2} + \frac{\Delta_2-\Delta_1}{\Sigma_1^2\Sigma_2^2}\right) + cM_3'\left(\frac{\Delta_3-\Delta_2}{\Sigma_2^2\Sigma_3^2} + \frac{\Delta_3-\Delta_1}{\Sigma_1^2\Sigma_3^2}\right)}{\frac{(\Delta_2-\Delta_3)^2}{\Sigma_2^2\Sigma_3^2} + \frac{(\Delta_1-\Delta_3)^2}{\Sigma_1^2\Sigma_3^2} + \frac{(\Delta_1-\Delta_2)^2}{\Sigma_1^2\Sigma_2^2}} \tag{26}$$

$$\Sigma^2 = \frac{\frac{1}{\Sigma_1^2} + \frac{1}{\Sigma_2^2} + \frac{1}{\Sigma_3^2}}{\frac{(\Delta_2-\Delta_3)^2}{\Sigma_2^2\Sigma_3^2} + \frac{(\Delta_1-\Delta_3)^2}{\Sigma_1^2\Sigma_3^2} + \frac{(\Delta_1-\Delta_2)^2}{\Sigma_1^2\Sigma_2^2}} \tag{27}$$

Equation (27) reduces to the two adduct equation (25) when one of the measurements becomes uninformative (e.g. the limit $\Sigma_3$ tends to infinity).

In addition to the variation in effects such as temperature and voltage stability introducing a systematic error in the mass accuracy other sources of error should also be considered. For example, absolute measurement error that depends on systematic calibration errors will also introduce error. Centroiding errors will also introduce error and chemical and electronic interference will also affect the measurements.

According to the embodiments, a linear drift or mass correction can be determined using measurements of a single experiment with analyte ions at two different charge states and/or derived from two different adduct ions. There may be cases where plural distinct sets of species of analyte ions are present with each set of species comprising a base compound having unknown molecular weight and a known set of adduct ions, for example in the analysis of complex mixtures. In these cases, the linear drifts or mass corrections determined from each set of species may be combined as appropriate, and the corresponding uncertainties may be determined and taken into account, to provide a linear drift/mass correction with improved accuracy/reduced uncertainty.

There may be cases where the uncertainty in the linear drift to be applied is determined to be comparable to or greater than the drift that may have occurred. Then, according to further embodiments, the calculated uncertainty may be used to determine whether or not the correction should be applied. In addition or alternatively, the uncertainty may be used to determine if more sets of analyte species should be located in the data and used for the calculation of a linear drift so as to reduce the uncertainty to or below a predetermined threshold value.

Embodiments have been contemplated wherein an instrument recalibration may be triggered if the magnitude of the calibration correction or linear drift exceeds a predetermined threshold value. The instrument calibration may be a calibration update using e.g. lock mass or a full instrument calibration.

FIG. 1 illustrates a mass spectrometer according to some embodiments. As shown in FIG. 1, a mass spectrometer 105 may include a control system 110 operative to perform methods according to the embodiments described herein. For example, the control system 110 may be arranged and adapted: (i) to mass analyse first ions derived from an analyte molecule, wherein said first ions have a first charge state; (ii) to determine a first mass or mass to charge ratio of said first ions; (iii) to mass analyse second ions derived from said analyte molecule, wherein said second ions have a second different charge state and wherein said second ions comprise protonated or adduct variants of said first ions; (iv) to determine a second mass or mass to charge ratio of said second ions; and (v) to determine a calibration correction based upon said first mass or mass to charge ratio and said second mass or mass to charge ratio. In another example, the control system 110 may be arranged and adapted: (i) to mass analyse first ions derived from an analyte molecule and first adduct ions; (ii) to determine a first mass or mass to charge ratio of said first ions; (iii) to mass analyse second ions derived from said analyte molecule and second adduct ions, wherein said second adduct ions have a second different mass to said first adduct ions; (iv) to determine a second mass or mass to charge ratio of said second ions; and (v) to determine a calibration correction based upon said first mass or mass to charge ratio and said second mass or mass to charge ratio.

EXAMPLE 1

According to a first example an analyte having an approximate molecular weight of 1000 may be considered.

According to this example the mass of the adduct ions (potassium adducts) $M_1$=156 and $M_2$=39 and according to this example the first charge state a=4 and the second charge state b=1.

If the mass spectrometer suffers an instrumental drift of 10 ppm, then according to the embodiment the difference in the measured molecular weight between the fourth and first charge states will be 1.2 ppm (±0.2 ppm standard deviation for each peak) and this will lead to a required correction of 10 ppm±1.7 ppm.

The embodiment therefore results in a substantial improvement (approximately factor ×5) after correction.

It may be desirable to minimize the factor ($mw/(M_a \times (a-b))$) and this can be done by using larger adducts and generating larger charge differences using charge stripping methods.

EXAMPLE 2

A second example will now be considered. According to the second example, an axial Matrix Assisted Laser Desorption Ionisation mass spectrometer may be used which results in the production of ions having a relatively high number of charges. The ions are generated by laser spray ionisation.

An analyte having a molecular weight of 5700 may be considered. The mass to charge ratio of MALDI matrix ions may be 224 and according to this example the first charge state a=8 and the second charge state b=1.

If the mass spectrometer were to suffer from an instrumental drift of 100 ppm then the difference in the molecular weights calculated according to the embodiment would be 27 ppm (±5 ppm standard deviation for each peak). This would lead to a correction of 100 ppm±18 ppm which corresponds with an approximately 5-fold improvement.

Although the technology described herein has been described with reference to the embodiments, it will be understood by those skilled in the art that various changes in form and detail may be made without departing from the scope as set forth in the accompanying claims.

The invention claimed is:

1. A method of calibrating a mass spectrometer comprising:

mass analysing first ions derived from an analyte molecule, wherein said first ions have a first charge state; determining a first mass or mass to charge ratio of said first ions;

mass analysing second ions derived from said analyte molecule, wherein said second ions have a second different charge state and wherein said second ions comprise protonated or adduct variants of said first ions;

determining a second mass or mass to charge ratio of said second ions; and calculating a calibration correction based upon said first mass or mass to charge ratio and said second mass or mass to charge ratio.

2. A method as claimed in claim 1, wherein the accuracy of said calibration correction is determined by the difference in charge between said first charge state and said second charge state.

3. A method as claimed in claim 1, wherein the accuracy of said calibration correction is improved by increasing the difference in charge between said first charge state and said second charge state.

4. A method as claimed in claim 1, wherein the step of calculating said calibration correction comprises determining a linear drift .alpha. of a mass, mass to charge ratio or time of flight scale of said mass spectrometer.

5. A method as claimed in claim 4, wherein said linear drift α is determined from the relationship $$\alpha = \frac{aM'_a - bM'_b}{(a-b)H}$$

wherein a is the charge state of said first ions, $M'_a$ is the mass to charge ratio of said first ions, b is the charge state of said second ions, $M'_b$ is the mass to charge ratio of said second ions and H is the mass of a proton.

6. A method as claimed in claim 4, wherein said linear drift α is determined from the relationship $$\alpha = \frac{aM'_a - bM'_b}{\Delta_a - \Delta_b}$$

wherein a is the charge state of said first ions, $M'_a$ is the mass to charge ratio of said first ions, $\Delta_a$ is the mass of adduct ions from which the first ions derived, b is the charge state of said second ions, $M'_b$ is the mass to charge ratio of said second ions and $\Delta_b$ is the mass of adduct ions from which the second ions derived.

7. A method as claimed in claim 1, further comprising using said calibration correction to correct the mass, mass to charge ratio or time of flight scale or calibration of said mass spectrometer.

8. A method as claimed in claim 1, further comprising determining an uncertainty value for said calibration correction.

9. A method as claimed in claim 8, wherein the step of determining said uncertainty value comprises determining a standard deviation Σ of said calibration correction, and said standard deviation Σ is determined from the relationship $$\Sigma^2 = \frac{\Sigma_a^2 + \Sigma_b^2}{(\Delta_a - \Delta_b)^2},$$

where $\Sigma_a$ is the standard deviation associated with the measurement of the first ions, $\Delta_a$ is the mass of adduct ions from which the first ions derived, $\Sigma_b$ is the standard deviation associated with the measurement of the second ions, and $\Delta_b$ is the mass of adduct ions from which the second ions derived.

10. A method as claimed in claim 9, further comprising determining if said calibration correction is to be applied to correct the mass, mass to charge ratio or time of flight scale or calibration of said mass spectrometer based on the determined uncertainty value.

11. A method as claimed in claim 10 wherein said calibration correction is applied when the determined uncertainty value is below a predetermined threshold value.

12. A method as claimed in claim 9 wherein said calibration correction is calculated for each of a plurality of different analyte molecules, and the calculated calibration corrections are combined to obtain a combined calibration correction.

13. A method as claimed in claim 1, comprising:

mass analysing third ions derived from said analyte molecule, wherein said third ions have a third different charge state and wherein said third ions comprise protonated or adduct variants of said first and second ions;

determining a third mass or mass to charge ratio of said third ions; and calculating a calibration correction based upon said first mass or mass to charge ratio, said second mass or mass to charge ratio and said third mass or mass to charge ratio.

14. A method as claimed in claim 13, further comprising determining an uncertainty value for said calibration correction by determining a standard deviation Σ of said calibration correction, and said standard deviation Σ is determined from the relationship $$\Sigma^2 = \frac{\frac{1}{\Sigma_a^2} + \frac{1}{\Sigma_b^2} + \frac{1}{\Sigma_c^2}}{\frac{(\Delta_b - \Delta_c)^2}{\Sigma_b^2\Sigma_c^2} + \frac{(\Delta_a - \Delta_c)^2}{\Sigma_a^2\Sigma_c^2} + \frac{(\Delta_a - \Delta_b)^2}{\Sigma_a^2\Sigma_b^2}}$$

where $\Delta_a$ is the mass of adduct ions from which said first ions derived, $\Sigma_a$ is the standard deviation associated with the measurement of the first ions, $\Delta_b$ is the mass of adduct ions from which said second ions derived, $\Sigma_b$ is the standard deviation associated with the measurement of the second ions, $\Delta_c$ is the mass of adduct ions from which said third ions derived, $\Sigma_c$ is the standard deviation associated with the measurement of the third ions.

15. A method of mass spectrometry comprising: a method of calibrating a mass spectrometer as claimed in claim 1.

16. A method of mass spectrometry as claimed in claim 15, further comprising calibrating said mass spectrometer without adding a reference standard to an analyte sample to be analysed or without using an ion source to generate a plurality of lockmass or external calibration ions.

17. A method as claimed in claim 1, wherein the step of calculating said calibration correction is performed by analytically calculating said calibration correction based upon said first mass or mass to charge ratio and said second mass or mass to charge ratio.

18. A method of calibrating a mass spectrometer comprising:

mass analysing first ions derived from an analyte molecule and first adduct ions;

determining a first mass or mass to charge ratio of said first ions;

mass analysing second ions derived from said analyte molecule and second adduct ions, wherein said second adduct ions have a second different mass to said first adduct ions;

determining a second mass or mass to charge ratio of said second ions; and calculating a calibration correction based upon said first mass or mass to charge ratio and said second mass or mass to charge ratio.

19. A method as claimed in claim 18, wherein the accuracy of said calibration correction is determined by the difference in mass between said first adduct ions and said second adduct ions.

20. A method as claimed in claim 18, wherein the accuracy of said calibration correction is improved by increasing the difference in mass between said first adduct ions and said second adduct ions.

21. A method as claimed in claim 18, wherein the step of calculating said calibration correction is performed by analytically calculating said calibration correction based upon said first mass or mass to charge ratio and said second mass or mass to charge ratio.

22. A mass spectrometer comprising a control system arranged and adapted:

(i) to mass analyse first ions derived from an analyte molecule, wherein said first ions have a first charge state;

(ii) to determine a first mass or mass to charge ratio of said first ions;

(iii) to mass analyse second ions derived from said analyte molecule, wherein said second ions have a second different charge state and wherein said second ions comprise protonated or adduct variants of said first ions;

(iv) to determine a second mass or mass to charge ratio of said second ions; and (v) to calculate a calibration correction based upon said first mass or mass to charge ratio and said second mass or mass to charge ratio.

23. A mass spectrometer as claimed in claim 22, wherein the control system is arranged and adapted to calculate said calibration correction by analytically calculating said calibration correction based upon said first mass or mass to charge ratio and said second mass or mass to charge ratio.

* * * * *